US005522321A

United States Patent [19]

Mosley et al.

[11] Patent Number: 5,522,321

[45] Date of Patent: Jun. 4, 1996

[54] DRAGSTER AMUSEMENT RIDE WITH ELASTIC CORD PROPULSION

[76] Inventors: Jimmy D. Mosley, 140 Bayou Rd.; Ernest D. Mosley, 572 Dunleth, both of Greenville, Miss. 38701

[21] Appl. No.: 423,930

[22] Filed: Apr. 18, 1995

[51] Int. Cl.[6] ..... A63G 7/00; A63G 31/02

[52] U.S. Cl. ..... 104/60; 104/67; 104/165; 104/287; 105/329.1; 185/38

[58] Field of Search ..... 104/53, 60, 67, 104/140, 165, 173.1, 202, 287; 105/238.1, 329.1; 446/444, 445, 446; 185/37, 38, DIG. 1

[56] References Cited

U.S. PATENT DOCUMENTS

| | | | |
|---|---|---|---|
| 1,454,760 | 5/1923 | Neary . | |
| 2,149,823 | 3/1939 | Weeks | 104/60 |
| 3,410,223 | 11/1968 | Miller | 104/60 |
| 3,844,557 | 10/1974 | Pompetti | 273/86 |
| 3,935,667 | 2/1976 | Vitt | 46/202 |
| 3,986,572 | 10/1976 | Gambon | 180/2 |
| 4,271,762 | 6/1981 | Wiegand | 104/69 |
| 4,476,947 | 10/1984 | Rynbrandt | 180/2.1 |
| 4,779,708 | 1/1989 | Handa et al. | 296/205 |
| 4,920,890 | 5/1990 | Barber | 104/53 |
| 4,949,814 | 8/1990 | Borovsky | 185/11 |
| 4,991,514 | 2/1991 | Powell et al. | 104/60 |
| 5,076,792 | 12/1991 | Niermann | 434/61 |
| 5,267,906 | 12/1993 | Kitchen et al. | 472/118 |
| 5,361,705 | 11/1994 | Powell | 104/60 |

*Primary Examiner*—Robert J. Oberleitner
*Assistant Examiner*—S. Joseph Morano
*Attorney, Agent, or Firm*—Jacobson, Price, Holman & Stern

[57] ABSTRACT

A pair of side-by-side track assemblies are provided and each track assembly has a wheeled, dragster simulating and occupant riding vehicle mounted thereon for guided movement longitudinally therealong. Each track assembly includes bungee cord vehicle accelerating structure for rapidly accelerating the corresponding vehicle along the track assembly toward the other end thereof and each track assembly other end includes bungee cord vehicle decelerating structure operative to engage the corresponding vehicle and to gradually increasingly decelerate the same as the vehicle moves along the track other end portion. In addition, the bungee cord decelerating structure is further operative, after decelerating the corresponding vehicle and terminating its movement toward the track structure other end portion, to accelerate the vehicle back toward the first end of the track assembly.

15 Claims, 5 Drawing Sheets

DRAGSTER AMUSEMENT RIDE WITH ELASTIC CORD PROPULSION

BACKGROUND OF THE INVENTION

1. Field of the Invention

This invention relates to a dragster-type amusement ride wherein side-by-side tracks of generally 600 feet in length are provided and a pair of dragster-type occupant rideable vehicles are mounted on the tracks for guided movement therealong. Similar bungee cord-type structures are provided at opposite ends of each track with the bungee cord structures at one pair of corresponding ends of the tracks being operable to accelerate the vehicles from a standstill throughout generally one quarter of the length of the track and the bungee cord structures at the other pair of corresponding ends of the tracks being operable to decelerate the vehicles, the vehicles being free of connections with the bungee cord structures and coasting down the tracks between the opposite end portions thereof.

2. Description of Related Art

Various different forms of bungee cord-type amusement rides, amusement ride track guidance systems, model guided dragster vehicles, tethered occupant riding vehicles, stretchable vehicle driving mechanisms and vehicle simulation amusement rides heretofore have been provided.

Examples of these previously known apparatuses are disclosed in U.S. Pat. Nos. 1,454,760, 3,844,557, 3,935,667, 3,986,572, 4,271,762, 4,476,947, 4,949,814, 5,076,792 and 5,267,906. However, these previously known structures do not include the overall combination of structural and operational features included in the instant invention.

SUMMARY OF THE INVENTION

The bungee dragster amusement ride of the instant invention incorporates a pair of side-by-side tracks and occupant rideable dragster-type vehicles guidingly mounted on the track for minimum frictionally resisted movement therealong.

At the "starting" end of the tracks bungee cord-type vehicle accelerating structures are provided with which the vehicles are releasably engageable and the bungee cord-type vehicle acceleration structures at the "starting" end of the track are capable of accelerating the vehicles down the track toward the "deceleration" ends of the tracks. The vehicle acceleration structures are capable of exerting acceleration forces on the vehicles throughout approximately one quarter the length of the tracks and the vehicles are then automatically freed from connection with the vehicle acceleration structures and coast toward the track deceleration ends.

At the track deceleration ends additional bungee cord structures are provided and automatically engages the rapidly moving vehicles for the purpose of decelerating them to standstill.

The connections of the acceleration structures to the vehicles are one way connections and the vehicles include accelerator pedal controlled latch structures for releasable connection to track supported anchor pins, whereby the vehicles may be held stationary, ready for acceleration, until the occupants of the vehicles depress simulated accelerator pedals as "christmas tree" lights signal the moment of desired vehicle release.

The deceleration structures at the far ends of the tracks are operable to automatically "catch" the vehicles and to increasingly decelerate the same. It is also possible that the deceleration structure will be operable to propel the vehicles, after being decelerated, back toward the "starting" end of the track (at a lower speed).

The main object of this invention is to provide a novel amusement ride which may be used by one or more persons at the same time.

Another object of this invention is to provide an amusement ride closely simulating dragstrip racing.

A further object of this invention is to provide an amusement ride which may initially subject the occupants of the vehicles to acceleration forces in excess of 1 G.

A further important object of this invention is to provide an amusement ride of the competition type and wherein more than one rider using the ride at one time may be in competition with each other.

Still another object of this invention is to provide an amusement ride which is extremely safe.

Another important object of this invention is to provide an amusement ride which utilizes only a small amount of electrical energy.

A final object of this invention to be specifically enumerated herein is to provide an amusement ride in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
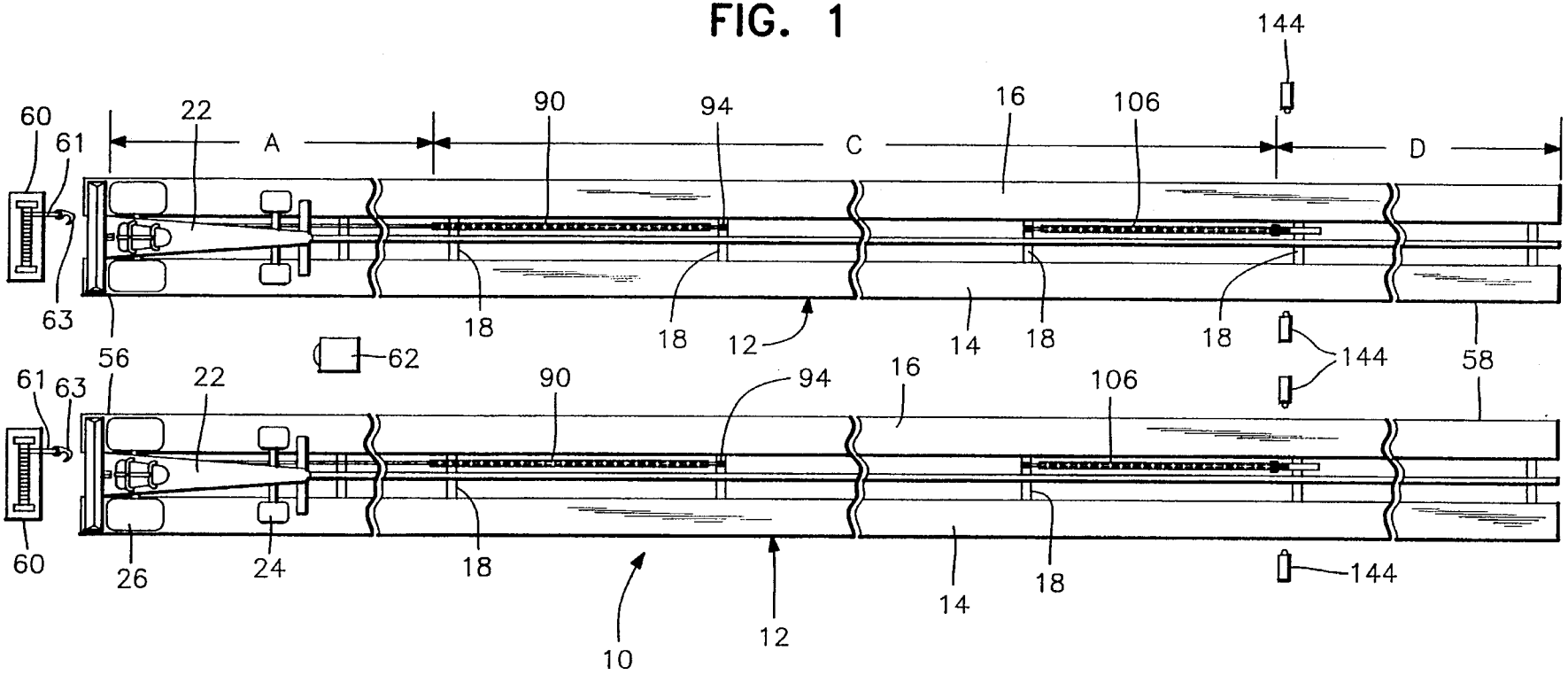
FIG. 1 is a fragmentary schematic top plan view of the amusement ride of the instant invention.
Figures 2, 3, 4, 5, 6, 7:
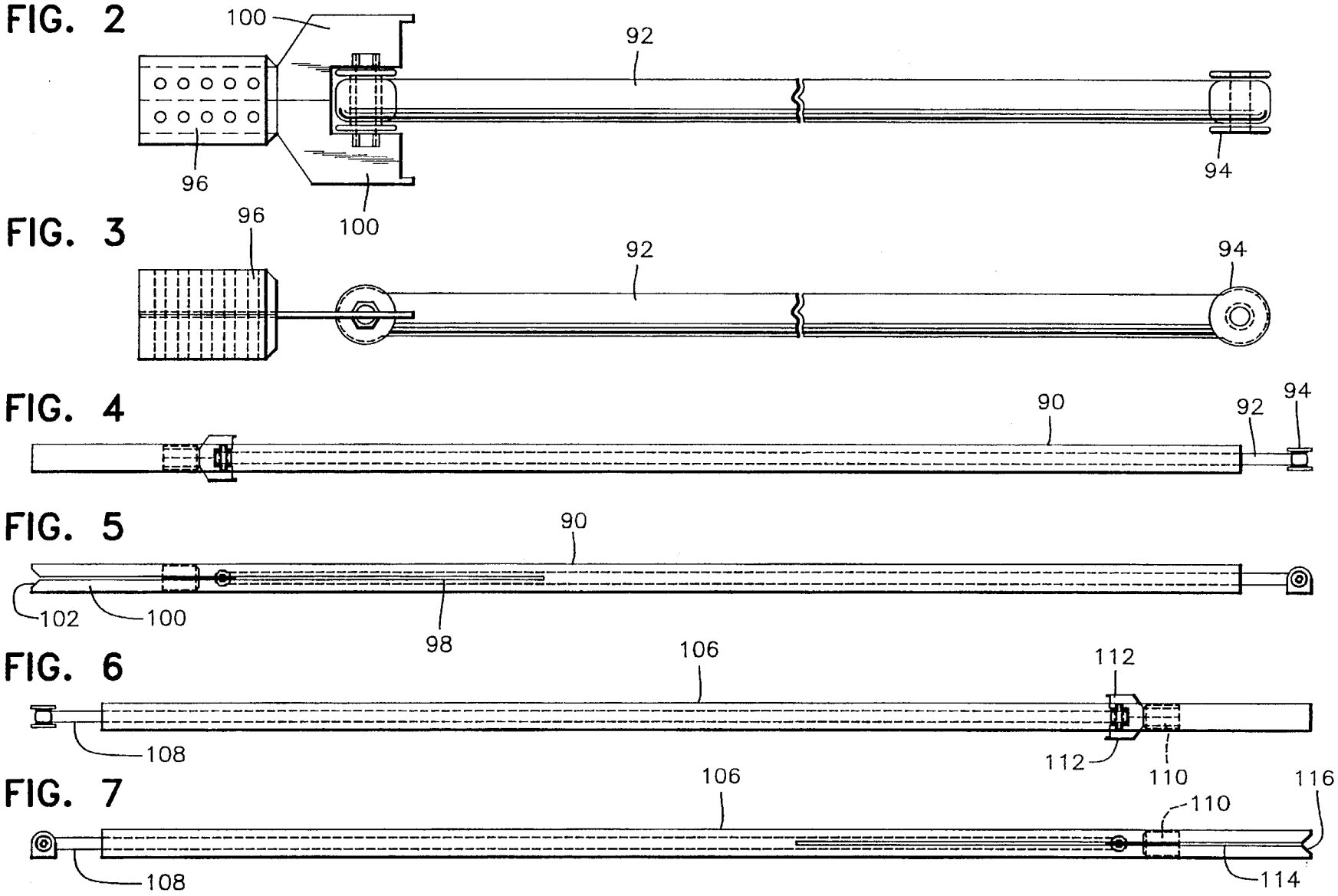
FIGS. 2 and 3 are fragmentary top plan and side views of the bungee cord structure by which the dragster vehicles are accelerated.
FIGS. 4 and 5 are top plan and side views of the acceleration bungee cord in a relaxed condition and contained within the stationary housing therefore.
FIGS. 6 and 7 are top plan and side elevational views similar to FIGS. 4 and 5 but illustrating the deceleration bungee cord assembly in a relaxed state received within its storage housing.

Referring now more specifically to the drawings and to FIGS. 1, 8, 9 and 10 in particular, the numeral 10 generally designates the amusement ride of the instant invention and includes a pair of side-by-side identical track assemblies referred to in general by the reference numerals 12. Each track assembly 12 incorporates a pair of wheel track members 14 and 16 rigidly interconnected at points spaced longitudinally therealong by transverse connecting members 18, the transverse connecting members 18 elevating the track members 14 and 16 above a supporting surface 20.

A pair of dragster simulating occupant rideable vehicles 22 are disposed on the track assemblies 12 for minimum frictionally resisted movement therealong, each vehicle 22 including small front wheels 24 and large rear wheels 26 rollingly engaged with the corresponding track members 14 and 16.

Figure 11:
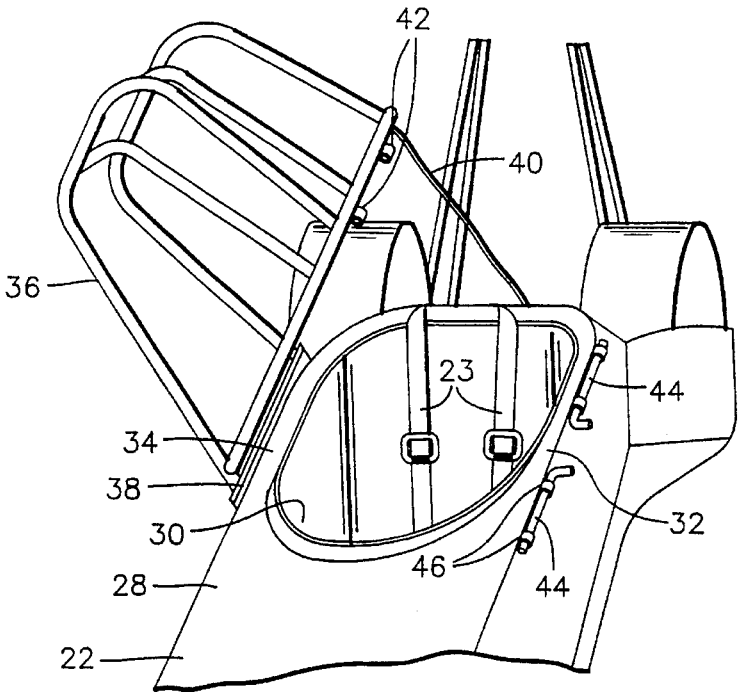
FIG. 11 is a fragmentary perspective view illustrating the roll cage over the cockpit area of one of the vehicles in an open position.

As shown in FIG. 11, each vehicle 22 includes a body 28 defining an interior cockpit area 30 between opposite side vehicle body portions 32 and 34. The cockpit area 30 includes a stationary simulated steering wheel (not shown) and a substantially conventional pivoted accelerated pedal (not shown) for a purpose to be hereinafter more fully set forth.

Figure 10:
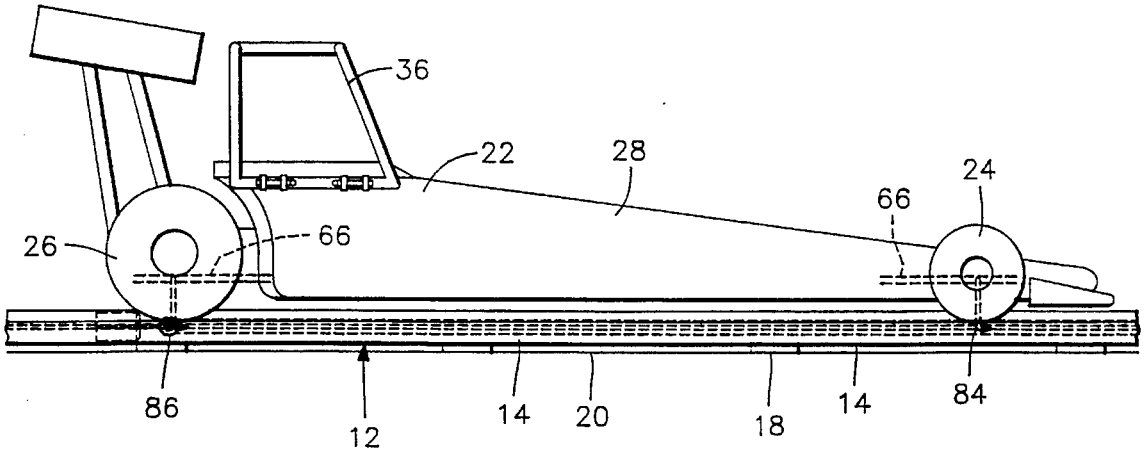
FIG. 10 is a fragmentary side elevational view illustrating one of the dragster vehicles at the "start" end of the associated track preparatory to acceleration downwardly along the track to the "finish" track end.

In addition, the body 28 includes a downwardly opening roll cage 36 pivotally supported from the body portion 34 as at 38 and swingable from the closed position thereof illustrated in FIG. 10 to an open position thereof such as that illustrated in FIG. 11, in which open position the roll cage 36 may be propped through the utilization of a temporary prop 40.

A pair of anchor sleeves 42 are carried by the swingable side margin of the roll cage 36 and may receive slidable locking bolts 44 therethrough when the roll cage 36 is in the closed position thereof illustrated in FIG. 10, the locking bolts 44 each being slidably supported from the body 22 through the utilization of mounting sleeves 46 and each anchor sleeve 42 is receivable between and axially aligned with a corresponding pair of mounting sleeves 46 when the roll cage 36 is in the closed position.

Preferably, the swingable side of each roll cage 36 will be disposed to the outside of the corresponding track assembly 12, that is to the side of the track assembly 12 remote from the adjacent track assembly 12.

Figure 13:
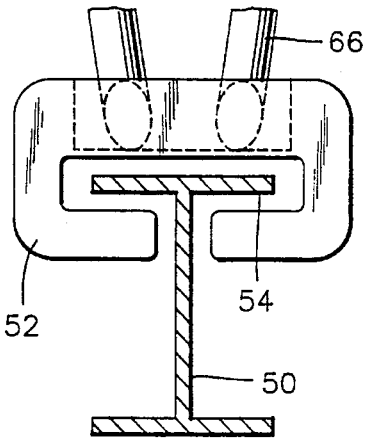
FIG. 13 is a fragmentary transverse vertical sectional view illustrating the vehicle forward fixed safety guide in operative association with the center guide I-beam.

Each track assembly 12 further includes a center guide I-beam 50 extending therealong between the track members 14 and 16 and the forward end of the tubular frame of each vehicle 22 includes a C-shaped stationary guide plate or member 52 which is loosely embraced about the upper horizontal flange 54 of the I-beam, see FIG. 13.

The track assemblies 12 include corresponding "start" ends 56 and corresponding "finish" ends 58. Also, a pair of multi-speed winch assemblies 60 are disposed at the start ends 56 of the track assemblies 12 for a purpose to be hereinafter more fully set forth. Further, a "christmas tree" light assembly 62 is positioned between the start ends 56 of the track assemblies 12 for viewing by the occupants of the vehicles 22 as they prepare for movement down the track assemblies 12 toward the finish ends 58 thereof.

Figure 8:
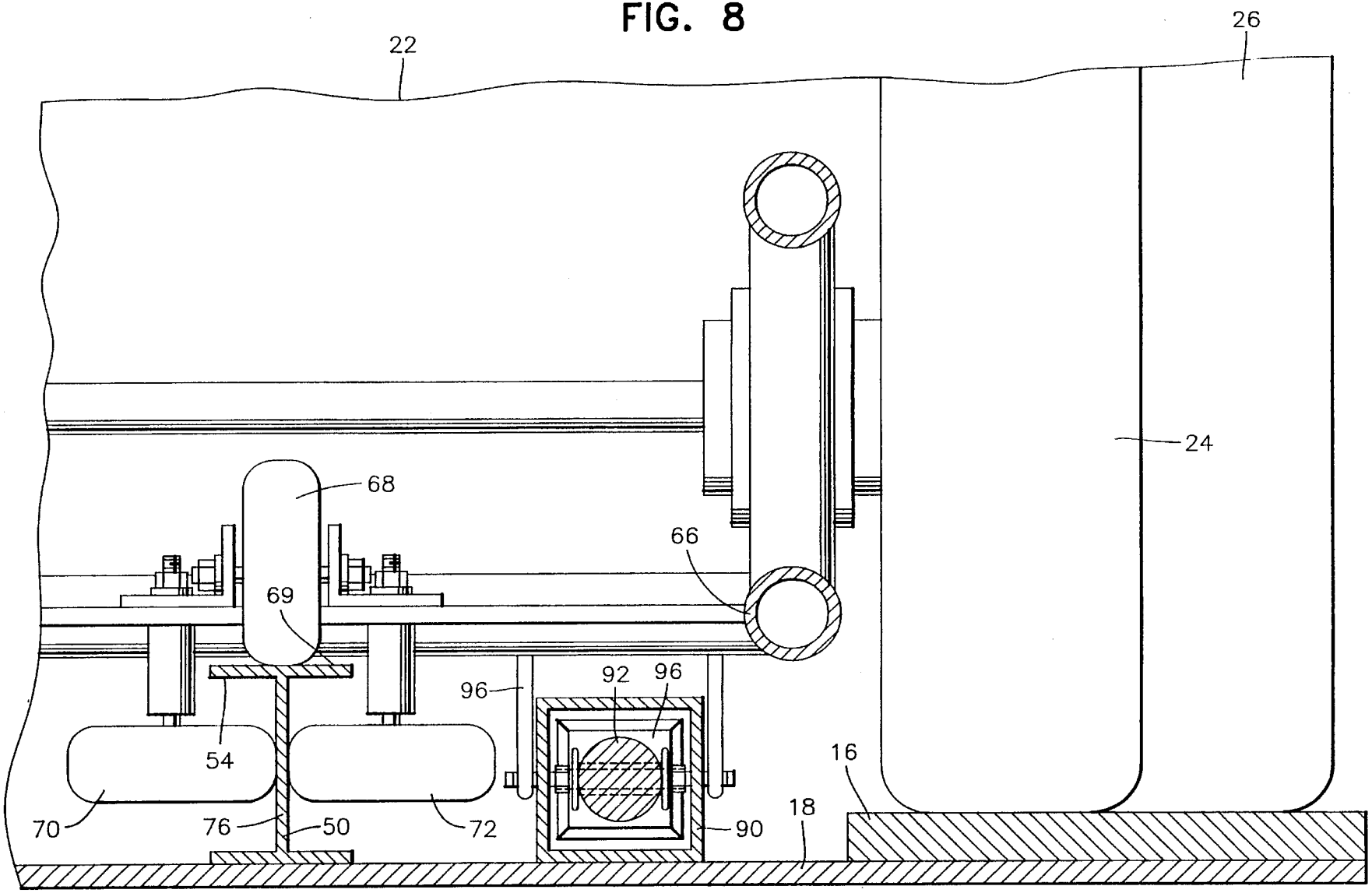
FIG. 8 is an enlarged fragmentary transverse vertical sectional view illustrating the guide wheels of one of the dragster vehicles rollingly engaged with the center guide I-beam and the acceleration hooks engaged with the anchor structure carried by the free end of the acceleration bungee cord.
Figure 9:
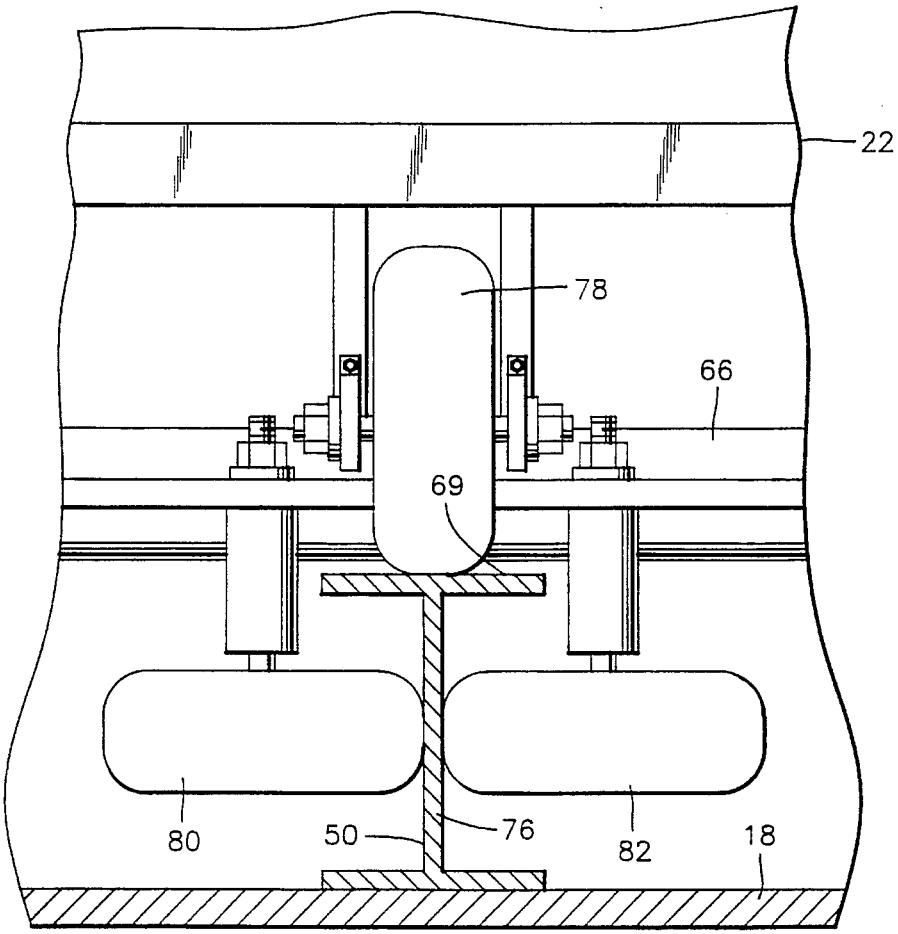
FIG. 9 is an enlarged fragmentary transverse vertical sectional view illustrating the rear guide wheels of the vehicle rollingly engaged with the center guide I-beam.

With attention now invited more specifically to FIG. 8, the forward portion of the tubular frame 66 of each vehicle 22 includes an upper wheel 68 journaled for rotation about a horizontal transverse axis rollingly engaged with the upper surface 69 of the upper flange 54 of the I-beam 50 and a pair of lower opposite side wheels 70 and 72 rollingly engaged with opposite side surfaces of the vertical web 76 of the I-beam 50. Furthermore, with attention invited more specifically to FIG. 9, the rear portion of the tubular frame 66 includes an upper wheel 78 journaled for rotation about a horizontal transverse axis and rollingly engaged with the upper surface 69 of the upper flange 54 and a pair of opposite side lower wheels 80 and 82 similar to the wheels 70 and 72 journaled for rotation about upstanding axes and rollingly engaged with opposite side surfaces of the vertical web 76 of the I-beam 50. In this manner, both the front and rear end portions of the tubular frame 66 are guidingly supported from the fixed center I-beam 50 of the corresponding track assembly 12.

With attention now invited more specifically to FIGS. 10 and 1–7, each vehicle 22 includes a downward projecting and forwardly opening forward hook 84 anchored relative to the frame 66 and a rear downwardly projecting and rearwardly opening hook 86 also rigidly supported from the tubular frame 66.

From FIG. 1 of the drawings it may be seen that an elongated tubular housing 90 is supported from each track assembly 12 and extends along the "start" end of the track assembly 12, the housing 90 being anchored relative to corresponding transverse connecting members 18. Each housing 90 encloses a bungee cord 92 (mechanical potential energy acceleration structure), see FIGS. 4 and 5, with the "finish" track end of the bungee cord 92 being anchored as at 94 to the track assembly 12. The "start" track end of each bungee cord 92 includes a replaceable guide follower 96 removably anchored relative thereto and the guide follower 96 is generally square in cross-sectional shape and is loosely received in the corresponding housing 90, see FIG. 8. The "start" track end of each housing 90 is slotted as at 98, see FIG. 5, and the corresponding follower 96 includes opposite side horizontally outwardly projecting wings 100 slidably received in and projecting outwardly through the slot 98, the "start" track end 100 of the housing 90 being bevelled as at 102 for assisting guidance of the wings 100 into the "start" track end of the slot 98 when the follower 96 is moved to the right as viewed in FIG. 5 outwardly of the housing 98 to stretch the bungee cord 92.

The "finish" track end of each track assembly 12 includes a second housing 106 supported therefrom in reversed left-to-right relation relative to the corresponding housing 90. The slotted housings 106 have bungee cords 108 (mechanical potential energy deceleration structure) operatively associated therewith and each bungee cord 108 includes a follower 110 corresponding to the follower 96 and equipped with horizontally outwardly projecting wings 112 corresponding to the wings 100, the "finish" track ends of the housing 106 being slotted as at 114 and bevelled as at 116, see FIGS. 6 and 7.

Figure 12:
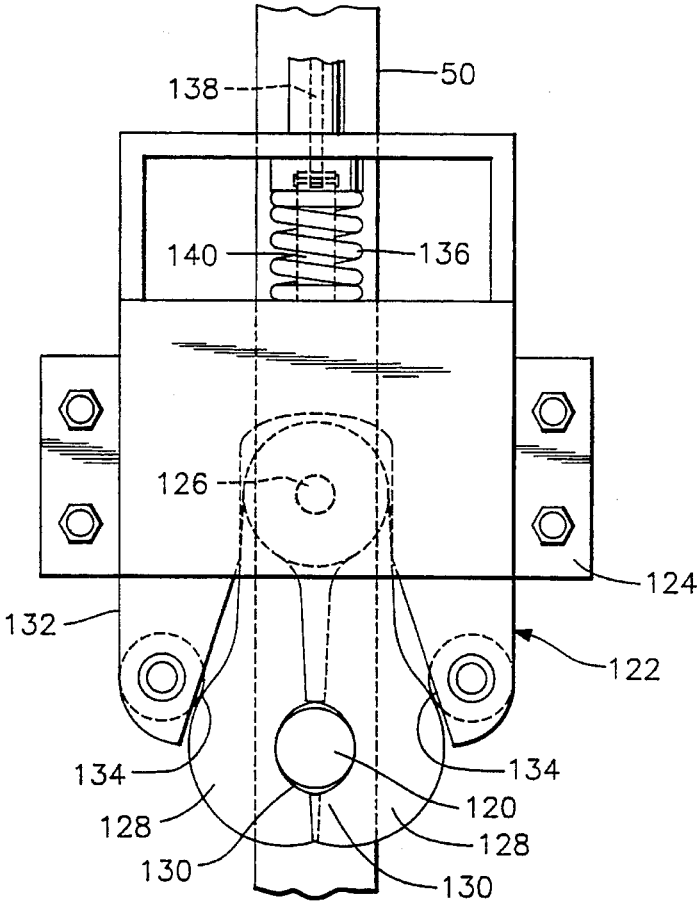
FIG. 12 is a fragmentary plan view illustrating the track mounted vehicle anchor pin and the vehicle latch structure latch engaged with the anchor pin.

With attention now invited more specifically to FIG. 12, it may be seen that each I-beam 50 includes an upwardly projecting anchor pin 120 adjacent the "start" track end thereof and that each vehicle 22 includes a latch assembly referred to in general by the reference numeral 122. Each latch assembly 122 includes a stationary mount 124 supporting a pivot pin 126 from which a pair of jaws 128 are pivotally supported, see FIG. 12. The free ends of the jaws 128 include opposing recesses 130 for clamping about the associated anchor pin 120 and each latch assembly 122 includes a spring biased actuator 132 equipped with rollers 134 rollingly engaged with remote sides of the jaws 128.

With attention directed more specifically to FIG. 12, when the actuator is in the rear position thereof illustrated in solid lines in FIG. 12, the rollers 34 prevent the rear ends of the jaws 28 from swinging away from each other and releasing the anchor pin 120. However, although the actuator 132 is spring biased by a compression spring 136 to the rear position thereof illustrated in FIG. 12, a control rod or cable 138 is operatively connected to the shank 140 of the actuator 132 and when a forward force is applied to the cable or rod 138, by depression of the aforementioned accelerator pedal, the actuator 132 is shifted forwardly so that the rear ends of the jaws 128 may swing apart and release the anchor pin 120. This of course releases the vehicle 22 for movement down the corresponding track assembly.

Referring now more specifically to FIG. 1, each track assembly 12 may be approximately 600 feet in length including a 160 foot acceleration zone A, a 218 foot deceleration zone D and a mid-length 222 foot intermediate coasting zone. Furthermore, the beginning of the deceleration zone D includes a set of conventional electric eyes 144 for terminating operation of a timing mechanism, not shown, and the more or less conventional "christmas tree" light assembly 62 is equipped with structure whereby the timing mechanism may be initiated. Thus, the running time of each vehicle 22 from the "start" position to the electric eyes 144, as determined by the start light on the christmas tree light assembly 62, is accurately timed and any suitable read out mechanism (not shown) may be provided for giving the "lapsed time" of a run.

Taking into consideration that the occupants of the two vehicles 22 may be of different weight, the anchor pins 120 may be mounted from the I-beams 50 in a manner such that they may be shifted longitudinally of the I-beams 50 in order to handicap the lighter driver. This may be accomplished either by shifting the anchor pin for the lighter driver slightly downwardly along the track and/or by shifting the anchor pin 120 for the heavier driver up the track. Still further, and possibly more conveniently, the anchor pins 120 may be rigidly mounted and the electric eyes 144 for the vehicle containing the heavier driver may be shifted back up the track, and/or the electric eyes 144 for the vehicle containing the lighter driver may be shifted downwardly along the track. Still further, the anchor pins 120 and electric eyes 144 may be permanently mounted and the gross weight of the vehicles 22 may be maintained constant either by removing weight from the vehicle 22 having a heavier driver, and/or by adding weight to a vehicle 22 having a lighter driver.

In operation, assuming that the vehicles 22 are initially positioned midway down the track assemblies 12, the winch assemblies 60 are actuated to unreel the cables 61 thereof and the hooks 63 at the free ends of the cables 61 may be engaged with a suitable anchor point (not shown) on each of the vehicles 22. Then, the vehicles 22 will be winched up the track assemblies 12 toward the starting ends 56 thereof and when the rear hooks 86 of the vehicles 22 engage the wings 100 of the followers 96, the bungee cords 92 will be stretched in up track directions from the housings 90 until such time as the anchor pins 100 are engaged by the jaws 128, the latter having been previously opened to receive the pins 120 therebetween. Then, after the jaws 128 have been locked about the anchor pins 120, the hooks 63 may be disengaged from the vehicles 22 and the persons to ride the vehicles 22 may enter the same and be strapped therein through the utilization of seat belts 23. After the roll cages 36 have been closed and locked in the closed positions the persons within the vehicles 28 may then give their attention to the christmas tree light assembly 62 and, upon the appropriate light being illuminated, foot actuate the previously mentioned accelerator pedal to thereby cause the jaws 128 to release the pins 120 and allow the tensioned bungee cords 92 to propel the vehicles 22 downwardly along the track assemblies 12.

As the vehicles 22 reach the bevelled ends 102 of the housings 90, the wings 100 are guided into the slots 98. At this point the bungee cords 92 are in a substantially relaxed condition, but the followers 96 still have considerable momentum which causes the follower 96 to continue onward through the housings until such time as the bungee cord buckles against the confining interior surfaces of the housing 90 so as to frictionally brake and thus arrest movement of the followers 96 downwardly along the housings 90. Of course, inasmuch as the hooks 86 open rearwardly, the vehicles are not slowed and continue downwardly along the track (while coasting) through the intermediate sections C of the tracks. Then, as the vehicles 22 reach sections D of the track assemblies 12, the front hooks 84 engage the wings 112 of the followers 110 and further forward movement of the vehicles 22 along the track assembly 12 is arrested by stretching of the bungee cords 108. As the vehicles are brought to rest by the bungee cords 108, they are then propelled more slowly back along the track assemblies 12 toward the start ends 56 thereof and in most cases will reach at least the areas of the housings 90. This automatic return of the vehicles 22 to the areas of the housings 90 will of course reduce the amount the cables 61 must be extended in order to be coupled to the vehicles 22 for return of the latter to the starting ends 56 of the track assemblies 12.

Of course, after a ride is over and the vehicles 10 are positioned in the areas of the housings 90, the occupants of the vehicles 22 may get out of the vehicles and, if desired, the new occupants may enter the vehicles 22 at that point before the vehicles 22 are pulled backward to the starting ends 56.

Of course, many different forms of guiding structures in lieu of the I-beams 50 may be utilized. Further, it is possible to utilized laterally spaced guide rails with each track assembly 12 and to place the housings 90 and 106 along the center lines of the track assemblies 12.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, elongated track means having opposite end portions and an intermediate portion extending between said end portions, an occupant rideable vehicle mounted on said track means for guided, minimum frictionally resisted movement along said track means, one end portion of said track means including mechanical potential energy acceleration structure selectively operable on said vehicle to exert an acceleration force thereon to accelerate said vehicle along said one end portion of said track means toward the other end portion thereof, said other end portion including mechanical potential energy deceleration structure operable to automatically physically engage said vehicle, upon the latter reaching said other end portion, and to exert a gradual deceleration force on said vehicle sufficient to fully absorb the kinetic energy thereof as well as the kinetic energy of an associated occupant and thereby terminate movement of said vehicle along said other end portion away from said one end portion.

2. The combination of claim 1 wherein said acceleration structure includes structure operative to exert a gradually fully diminishing acceleration force on said vehicle.

3. The combination of claim 1 wherein said deceleration structure includes structure operative to exert a gradually increasing deceleration force on said vehicle.

4. The combination of claim 3 wherein said acceleration structure includes structure operative to exert a gradually fully diminishing acceleration force on said vehicle.

5. The combination of claim 1 wherein said acceleration structure includes a first elongated stretchable member including a first end anchored relative to said track means adjacent the end of said one end portion adjacent said intermediate portion and a second end extending and stretchable away from said other end portion, said vehicle and said second end including coacting anchor means operable to releasably anchor said second end relative to said vehicle.

6. The combination of claim 5 wherein said deceleration structure includes a second elongated stretchable member including a first end anchored relative to said track means adjacent the merging of said other end portion and said intermediate portion and a second end extending and stretchable toward the end of said other end portion remote from said one end portion, said vehicle and said second end of said second elongated member including coacting anchor means operative to automatically releasably anchor said second end of said second elongated member to said vehicle upon movement of said vehicle along said track means other end portion away from said track means first end portion.

7. The combination of claim 5 wherein said track means and said first elongated member include means operative to automatically frictionally brake movement of said first elongated member second end toward said other end portion upon said first elongated member returning to a static, non-stretched condition.

8. The combination of claim 6 wherein said track means and said second elongated member includes means operative to automatically frictionally brake movement of said second elongated member second end toward said track means one end portion upon said second elongated member returning to a static, non-stretched condition.

9. The combination of claim 1 wherein said vehicle includes a body defining a forward facing, upwardly opening occupant cockpit in which to receive an occupant in a seated position with at least the head of the occupant projecting above the body portion of said vehicle forward of said cockpit, said body including first and second laterally spaced side portions between which said cockpit is defined, a roll cage disposed over at least a major portion of said cockpit and including first and second opposite lower side margins, said first opposite side margin being pivotally anchored to said first side portion of said vehicle for swinging of said roll cage relative to said body about a horizontal axis extending longitudinally of said track means between open and closed positions with said second side margin swung upwardly and away from said body second side portion and a closed position with said second side margin swung downwardly toward and adjacent said second side portion, said second side margin and said second side portion including coacting latch means releasably latching said roll cage in said closed position.

10. The combination of claim 1 wherein said deceleration structure includes structure, after fully absorbing the kinetic energy of said vehicle as well as the kinetic energy of an associated occupant, to accelerate said vehicle back along said track means toward said one end portion thereof.

11. The combination of claim 10 wherein said acceleration structure includes structure operative to exert a gradually fully diminishing acceleration force on said vehicle.

12. The combination of claim 10 wherein said deceleration structure includes structure operative to exert a gradually increasing deceleration force on said vehicle.

13. The combination of claim 12 wherein said acceleration structure includes structure operative to exert a gradually fully diminishing acceleration force on said vehicle.

14. The combination of claim 10 wherein said acceleration structure includes a first elongated stretchable member including a first end anchored relative to said track means adjacent the end of said one end portion adjacent said intermediate portion and a second end extending and stretchable toward said first end, said vehicle and said second end including coacting anchor means operable to releasably anchor said second end relative to said vehicle.

15. The combination of claim 14 wherein said deceleration structure includes a second elongated stretchable member including a first end anchored relative to said track means adjacent the merging of said other end portion and said intermediate portion and a second end extending and stretchable toward the end of said other end portion remote from said one end portion, said vehicle and second end of said second elongated member including coacting anchor means operative to automatically releasably anchor said second end of said second elongated member to said vehicle upon movement of said vehicle along said track means other end portion away from said track means one end portion.

* * * * *